US006540007B2

(12) United States Patent
Meyer

(10) Patent No.: US 6,540,007 B2
(45) **Date of Patent: *Apr. 1, 2003**

(54) MOLDING PROCESS FOR THE MASS PRODUCTION OF ALUMINUM ALLOY CASTINGS AND ASSOCIATED ITEMS OF EQUIPMENT

(75) Inventor: Philippe Meyer, Ronquerolles (FR)

(73) Assignee: Montupet S.A. (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/265,605

(22) Filed: Mar. 10, 1999

(65) Prior Publication Data

US 2001/0050156 A1 Dec. 13, 2001

(30) Foreign Application Priority Data

Mar. 10, 1998 (FR) ..... 98 03028

(51) Int. Cl.[7] ..... B22D 15/00; B22D 18/04

(52) U.S. Cl. ..... 164/119; 164/127; 164/130; 164/136

(58) Field of Search ..... 164/359, 360, 164/136, 352, 353, 354, 119, 63, 255, 306, 127, 130, 323, 167

(56) References Cited

U.S. PATENT DOCUMENTS

| | | | | |
|---|---|---|---|---|
| 3,123,877 A | | 3/1964 | Sylvester | 164/120 |
| 3,905,419 A | | 9/1975 | Tenner | 164/337 |
| 5,163,500 A | | 11/1992 | Seaton et al. | |
| 5,492,165 A | * | 2/1996 | Erana | 164/119 |

FOREIGN PATENT DOCUMENTS

| | | |
|---|---|---|
| DE | 2056243 | 5/1972 |
| DE | 1911573 | 6/1972 |
| DE | 2652657 | 6/1977 |
| DE | 2747320 | 5/1979 |

(List continued on next page.)

OTHER PUBLICATIONS

Patent Abstracts of Japan; vol. 5, No. 190 (M–100) (862) Dec. 4, 1981 56–111,567, Sep. 1981.
Patent Abstracts of Japan; vol. 7, No. 47 (M–196) (1192) Feb. 24, 1983 57–195,575, Dec. 1982.
Patent Abstracts of Japan; vol. 5, No. 190 (M–100) (862) Feb. 24, 1983 56–111,564, Sep. 1981.
Patent Abstracts of Japan; vol. 15, No. 134 (M–1099) Apr. 3, 1991 3–018,453, Jan. 1991.

*Primary Examiner*—Kuang Y. Lin
(74) *Attorney, Agent, or Firm*—Blakely Sokoloff Taylor & Zafman

(57) ABSTRACT

A process for molding a casting made of light alloy comprises the steps consisting in:

preparing a mold with a print made of physically setting sand, incorporating a movable closure means in the mold near a feed runner of the mold, placing the mold in such a way that its feed runner is in the lower part, connecting the feed runner of the mold to a tube for feeding with a pressurized molten alloy, filling the mold with said alloy, before any substantial solidification of the casting, moving the closure means in order to close off the feed runner, then rotating the mold through approximately 180° in order to ensure solidification in gravity mode.

Application especially to the manufacture of engine blocks for motor vehicles.

13 Claims, 9 Drawing Sheets

FOREIGN PATENT DOCUMENTS

| | | | | |
|---|---|---|---|---|
| DE | 29708575 | 9/1997 | | |
| EP | 0152754 | 8/1985 | | |
| EP | 0234877 | 12/1989 | | |
| EP | 0752292 | 1/1997 | | |
| FR | 715226 | 12/1931 | | |
| FR | 1424986 | 3/1966 | | |
| FR | 1560465 | 3/1969 | | |
| FR | 2177466 | 11/1973 | | |
| GB | 1028736 | * 5/1966 | ..... | 164/119 |
| GB | 1410770 | 10/1975 | | |
| JP | 2-41738 | * 2/1990 | | |
| WO | WO88/06501 | 9/1988 | | |
| WO | WO9000101 | 1/1990 | | |
| WO | WO91/12104 | 8/1991 | | |
| WO | WO93/11892 | 6/1993 | | |
| WO | WO95/32826 | 12/1995 | | |

* cited by examiner

MOLDING PROCESS FOR THE MASS PRODUCTION OF ALUMINUM ALLOY CASTINGS AND ASSOCIATED ITEMS OF EQUIPMENT

FIELD OF THE INVENTION

The present invention relates to a novel process for producing castings made of aluminum alloy, as well as to a plant for implementing this process.

BACKGROUND OF THE INVENTION

The current growth of aluminum in the automobile field means that new processes have to be developed, these being tailored to the need to minimize production costs as well as being tailored to mass production (typically, several hundred thousand castings per year and per type of product) and, finally, tailored to the production of castings optimum quality and of increasingly complex geometry, especially due to the constraint of antipollution regulations, resulting in the search for systematic lightening, maximum compactness, optimum performance and integration of functions.

This quality depends both on metallurgical aspects (namely the search for the highest properties with a casting microstructure as fine as possible and as clean as possible in the stressed zones) and on dimensional aspects (in particular, the maximum dimensional precision of all the geometries of the casting, these being critical for the performance of the vehicle.

Certainly, there are a number of processes available for producing automobile castings. However, none of these processes seems to have, at the present time, a combination of characteristics which fully satisfies the combination of requirements mentioned above.

Processes for casting into metal molds, essentially the gravity process and the low-pressure process, are, certainly, economically efficient and deliver a high level of metallurgical and dimensional quality. However, they are unsuitable for producing castings of complex shape.

Thus, the internal shapes are in this case produced by cores of chemically bonded sand, and these processes are very suitable only if it is possible to rapidly insert all these cores after opening the mold and extracting the previous casting. This means that the positioning sequences on the mold have to remain relatively simple, and this therefore proves to be incompatible in some situations, for example in the case of engine blocks or cylinder heads, in which up to twelve cores, or more, have to be put into position along quite complex paths and therefore take an excessively long time to do so.

There are also processes called "sand packing" processes, especially the process developed by COSWORTH CASTINGS, which were developed in order to meet the abovementioned objectives. However, these processes are very expensive as they have to use a large quantity of chemically bonded sand. Furthermore, in the case of the COSWORTH process, the need to use a special sand of the zircon type, instead of silica sand normally used in foundrywork, also contributes to very high operating costs. Moreover, these processes do not make it possible to achieve the metallurgical quality that may be achieved with the use of molds composed of metal components, which allow the rate of solidification of the aluminum alloy in the most critical zones to be increased to the maximum possible.

There is also a process called the "lost foam" process which does indeed satisfy the constraints of geometrical complexity and large-scale production. However, the level of metallurgical quality obtained is very much inferior to the current standards in metal-mold casting (gravity or low-pressure casting), so that this process cannot at the present time be envisaged for certain highly stressed applications.

SUMMARY OF THE INVENTION

The present invention aims to alleviate the limitations of the prior art and to provide a casting process which better meets the market requirements, particularly the automobile market, and which remains economical to implement.

Another object of the present invention is to provide a casting process using, to at least a substantial extent, physically setting sand, or green sand, which does not raise the particular recycling and environmental problems encountered with chemically setting sands.

Thus, the invention according to a first aspect provides a process for molding a casting made of light alloy such as an aluminum alloy, characterized in that it comprises the successive steps consisting in:

- preparing a mold with a print made of physically setting sand,
- incorporating a movable closure means in the mold near a feed runner of the mold,
- placing the mold in such a way that its feed runner is in the lower part,
- connecting the feed runner of the mold to a tube for feeding with a pressurized molten alloy,
- filling the mold with said alloy,
- before any substantial solidification of the casting, moving the closure means in order to close off the feed runner, then rotating the mold through approximately 180° in order to ensure solidification in gravity mode.

Preferred, but nonlimiting, aspects of the process according to the invention are as follows:

- provision is furthermore made, between the filling and solidifying steps, for a step of closing off said lower region of the mold followed by separation of the mold from a tube for feeding with molten alloy;
- the closure step is carried out less than approximately ten seconds after the end of the filling step;
- the rotation step is completed at most 25 seconds, preferably 15 seconds, after the end of closing off;
- the rotation step is completed at most 15 seconds, preferably 5 seconds, after the end of closing off;
- the rotation step is completed at most 15 seconds, preferably 5 seconds, after the end of filling;
- the process uses a mold made of silica sand having a particle size of at least 40 ASS, preferably at least 55 AFS, or at least 80 AFS for excellent surface condition;
- a mold consisting of two half-frames is used and the step of mold preparation comprises the steps of molding two half-prints in the two half-frames, positioning molding cores into the two half-frames placed with their prints facing upwardly, and assembling the two half-frames;
- the step of assembling the two half-frames results in a mold in a generally horizontal position, and the process furthermore comprises the step consisting in tilting the mold into a generally vertical filling position;
- the cores are made of chemically setting sand;
- the cores are made of silica sand having a particle size of at least 40 AFS;
- provision is furthermore made, after the casting has solidified, for a step of separating the casting from the mold, allowing the print sand and the core sand to be recovered separately;

provision is furthermore made, before the mold filling step, for a step of positioning at least one solid cooler placed at in a region of the mold which is some distance from said feed region of the mold and, after solidification, a step of recovering the cooler or coolers.

According to a second aspect, the invention provides a plant for molding a casting made of light alloy such as an aluminum alloy, characterized in that it comprises:

a mold which can be turned upside down, by rotating it about an essentially horizontal axis, having a runner for feeding with molten alloy and incorporating a means for closing off said runner, and a mold handling device capable of moving the mold, by rotating it about said horizontal axis, and having a means for actuating said closure means.

Preferred aspects of this plant are as follows:

the handling device has means for moving the mold translationally in the direction of a tube for feeding with molten alloy;

the handling device is also capable of moving the mold, by rotating it about said horizontal axis, between an initial position, on leaving a mold assembly station, and a molding position;

the handling device is capable of moving the mold about a vertical axis in order for it to engage respectively with a conveyor for bringing the mold in, a low-pressure casting furnace fitted with said feed tube, and a conveyor for taking the mold away.

Finally, according to a third aspect, the invention provides a mold intended for casting a casting made of light alloy such as an aluminum alloy, the mold being provided with a runner for feeding with pressurized molten alloy, the mold being characterized in that it is mounted so as to rotate about an essentially horizontal axis, so as to be able to be turned upside down after filling, and in that it comprises a means for mechanically closing off said feed runner.

Preferred, but optional, aspects of this mold are as follows:

the mold has at least one print made of physical setting sand and said mechanical closure means comprises a metal plate incorporated in the print and guided directly by the latter;

the mold comprises a blind hole terminating in line with one edge of said metal plate and capable of housing a rod of a means for actuating said plate;

said plate has at least one guiding appendage which, in an initial position of said plate, engages in an opposite print of the mold.

BRIEF DESCRIPTION OF THE DRAWINGS

Further aspects, objects and advantages of the present invention will become more apparent on reading the following detailed description of an illustrative embodiment of the latter, given by way of example and with reference to the appended drawings, in which.

DETAILED DESCRIPTION OF THE INVENTION

Figure 1:
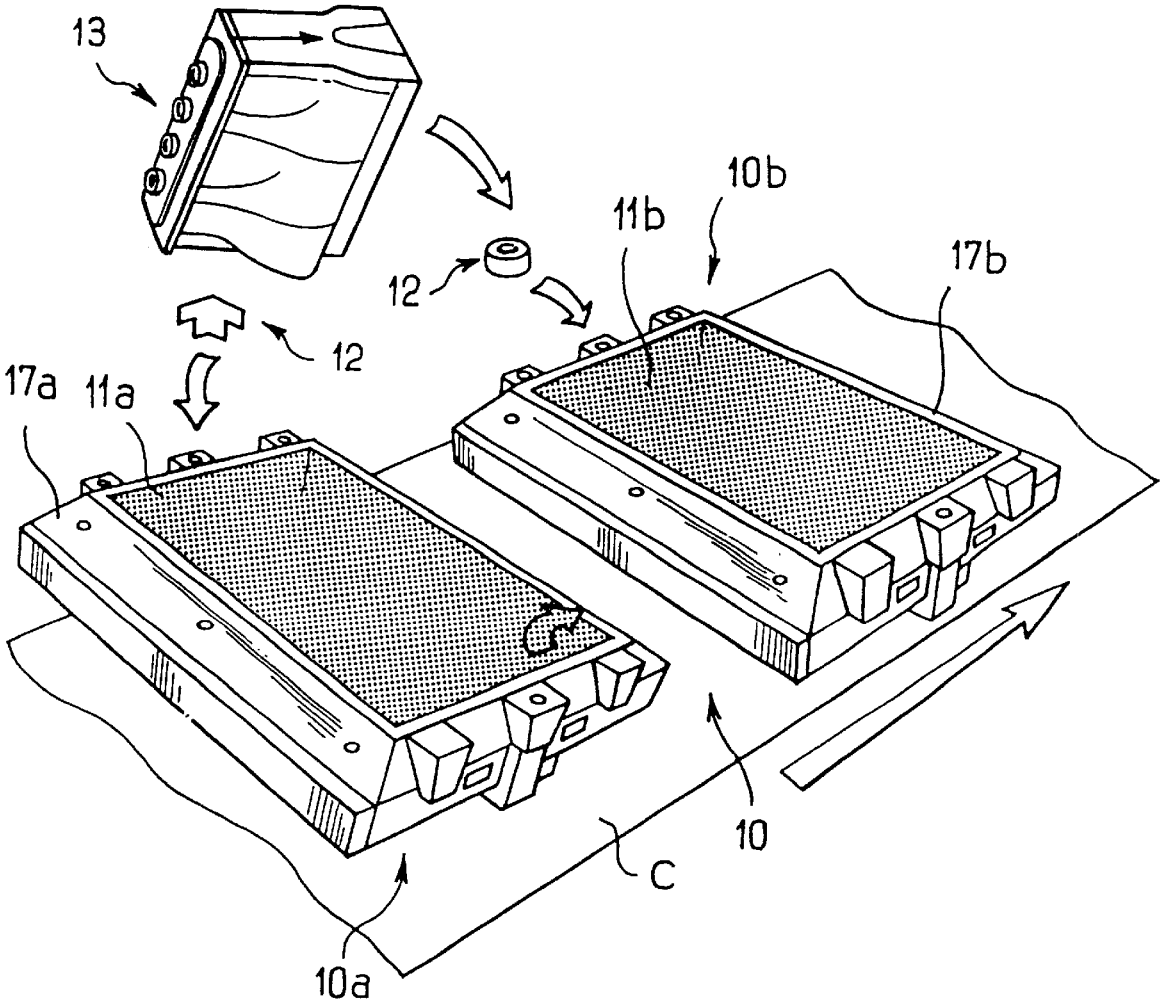
FIG. 1 is a diagrammatic perspective view of a mold and of its cores used in a process according to the present invention, during a mold assembly step.

Referring firstly to FIG. 1, this shows a mold 10 whose prints are formed by physically bonded sand, i.e. sand that does not use a thermally or chemically curing resin, and preferably by green sand.

By way of information, it should be noted here that green sand has a cost per unit weight which is ten to fifteen times less than that of a chemical sand of the cold-box type. Furthermore, this type of sand does not cause the recycling and pollution problems posed in a known manner by chemically setting sands.

This sand is used "in box", essentially the mold, made in the form of two half-molds 10*a* and 10*b*, consisting of two metal half-frames 17*a*, 17*b*, each half-frame carrying a half-print 11*a*, 11*b* produced, by the usual technologies for producing green sand molds, with the aid of a pattern.

Before the two half-frames are closed up on each other, each half-frame is placed on a conveyor C in the open position, with the print facing upwardly, so as to facilitate mold assembly, i.e. the positioning of the various cores and inserts (the main set of cores 13 and individual secondary cores 12) intended for obtaining the internal shapes and certain external shapes of the casting to be produced, the example diagrammatically illustrated here being that of an engine block.

These cores may be handled manually in the case of small cores 12, or else by robots operating in successive workstations (in the case of the main set of cores 13). These cores are preferably made of chemically setting sand (preferably of the cold-box type or that used for the "Isocet"-type process. For cost reasons, it is preferred to use silica sand ($SiO_2$) having a particle size of approximately 55–60 AFS or higher, the best surface finishes being obtained using the highest AFS particle size values).

Figure 2A:
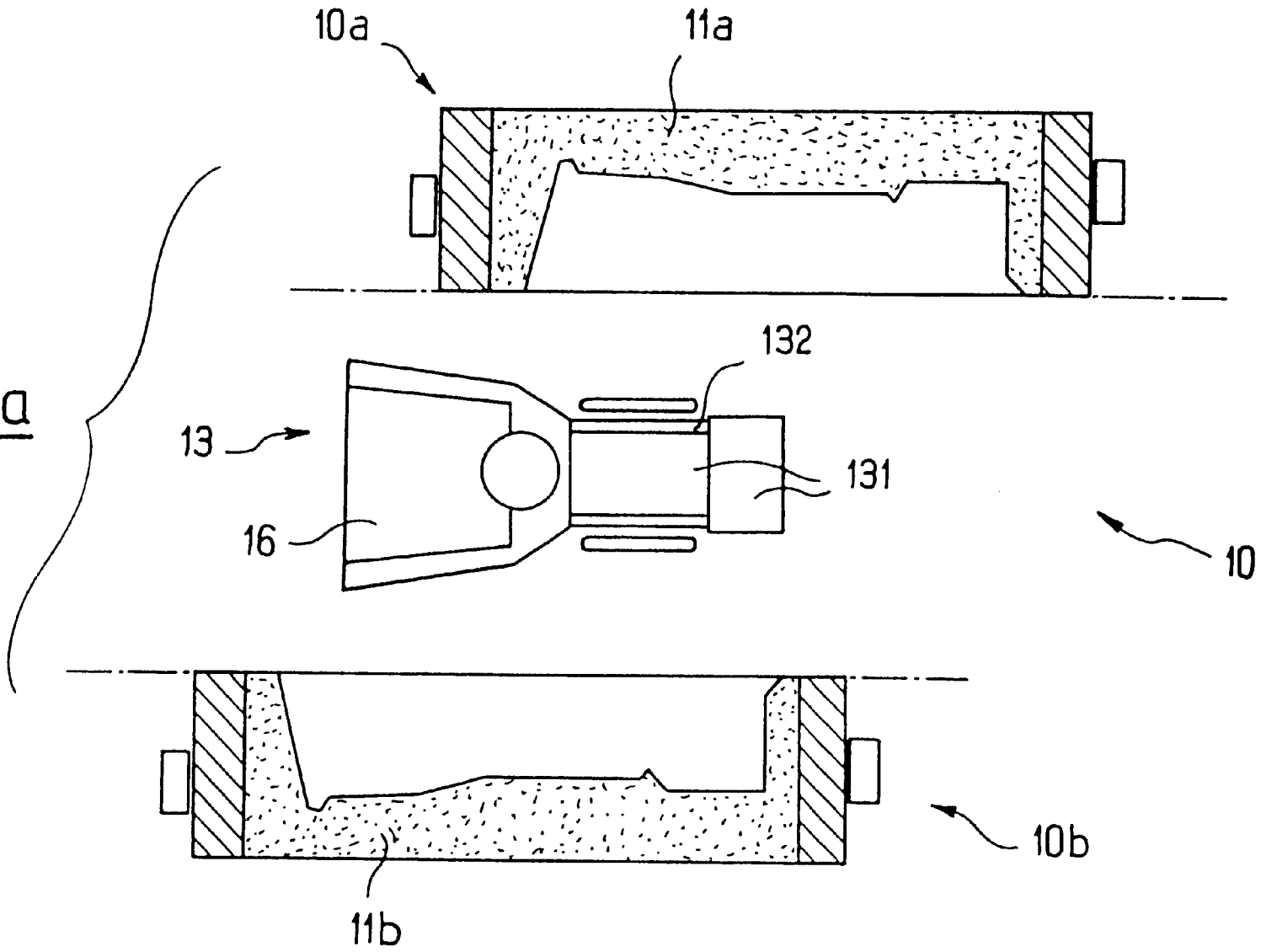
FIG. 2*a* illustrates the constituents of the mold to be assembled in an exploded side elevation, FIGS. 2*b* and 2*c* diagrammatically illustrate, in cross section, the assembled mold during two operating phases of the process, FIGS. 3*a* to 3*e* diagrammatically illustrate five successive steps of the molding process according to the invention, FIGS. 4*a* to 4*d* diagrammatically illustrate four successive steps for fitting a closure device into the mold, FIG. 5 diagrammatically illustrates, in perspective, the closure device region in the situation in FIG. 4*a,*

FIG. 2*a* shows that the main set of cores 13 has, in the present example, apart from various chemical sand cores 131 forming the desired geometry, metal inserts 132 intended to form cylinder liners, as well as a solid metal cooling block 16, as will be seen later. Such cooling block can be incorporated into the core set 13 during while the cores 131 are made, so as to secure together the cores and the cooler.

Once the cores have been fitted, the two half-frames are assembled, the upper half-frame, initially placed beside the lower half-frame, with the print facing upwardly, being rotated through 180° (see the position in FIG. 2*a*) in order to be assembled on the lower half-frame, with suitable position-indexing means.

Figure 2C:
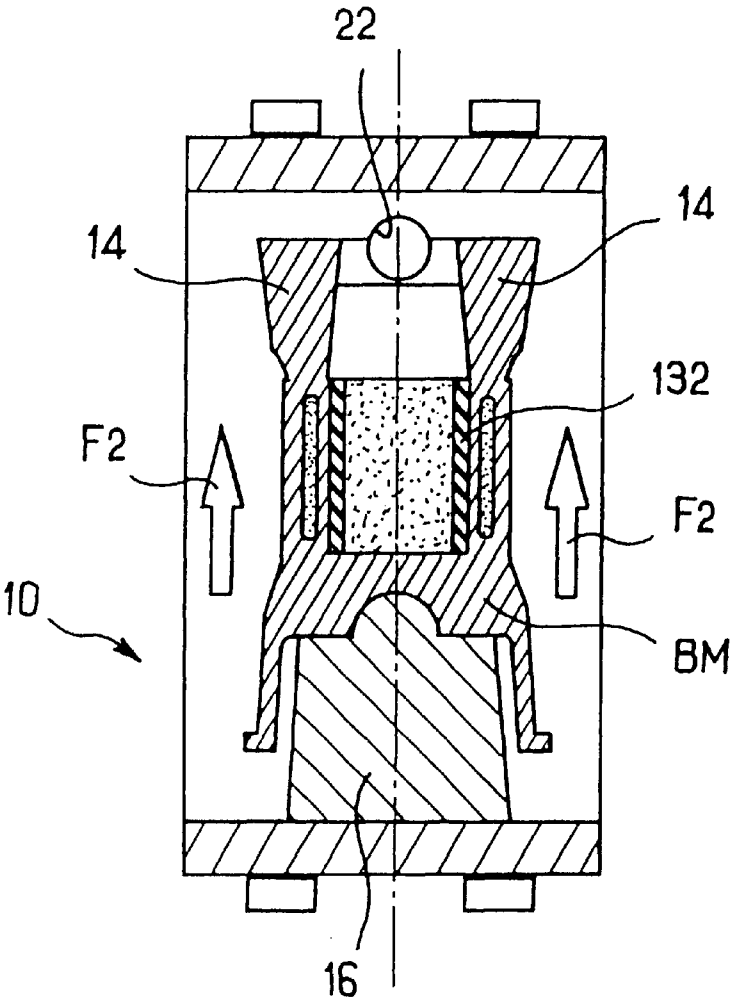
Figure 2B:
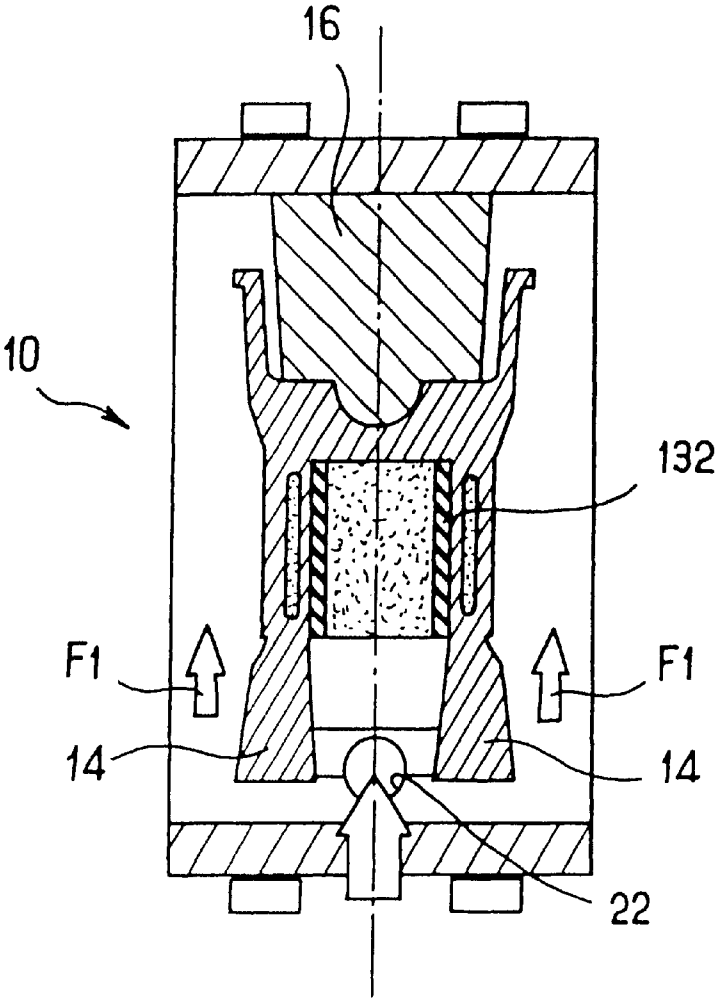

Referring now to FIGS. 2*b* and 2*c*, FIG. 2*b* illustrates the position of the mold 10 during the filling phase, the example being always that of molding an engine block.

This filling takes place via the feeder heads 14, with low-pressure feeding, the runner 22 of which is in the part then at the bottom of the mold. The direction of rise of the liquid metal is denoted by the arrows F1.

It will be noted here that simple gravity filling is excluded here because of the risk of turbulence and of the creation of oxides that it generates. The reason for this is that any oxide created in the feed system would in this case be carried into the casting and irremediably trapped therein.

In contrast, the fact of using low-pressure filling allows this filling operation to be perfectly controlled, without the creation of turbulence, and, right from the start, providing the correct thermal gradient in the casting and the mold, the feeder heads 14 constituting the hottest regions right after filling.

The practical operation of low-pressure filling preferably takes place by bringing the sand mold 10 into contact with a dip tube (not illustrated in FIG. 2*a*) connected to a sealed furnace of the low-pressure furnace type, which in itself is conventional. After this contacting operation, the rise of the metal and the control of the flow are brought about by pressurizing the furnace. As a variant, an electro-magnetic pump may also be used.

One advantageous feature of the process according to the invention is the use of a mechanical device for closing off the feed system right after the filling operation and before the mold is rotated through 180°. The purpose of such a rotation is to bring the feeder heads 14 into the top position and to cause solidification under conditions identical to those in a gravity feed operation.

The rotation must be carried out as soon as possible after the closure. Tests have in fact made it possible to demonstrate that if too long a time elapses after closure before turning the mold upside down, defects appear in the casting in the form of wrinkles or cavities, making the casting unsuitable for use. These defects are explained by incipient solidification in the coldest regions of the mold before turning it upside down.

Specifically, for a casting of the type consisting of an engine block or cylinder head of an automobile engine, the rotation must be carried out at most 15 seconds, and preferably at most 5 seconds, after the closure operation.

The closure operation itself is carried out as soon as possible after the end of filling, so as not to waste time and so as not to be disturbed by incipient solidification in the feed runner. Advantageously, the closure operation takes place at most 10 seconds after the end of filling, although exceeding this limit does not prejudice the soundness of the casting.

Mechanically closing the feed before turning the mold upside down has many advantages.

First of all, it allows the pressure to be immediately released and the casting to be turned upside down without it being under liquid pressure. This avoids having to fit a complex rotary seal on the sand mold.

Moreover, in all situations it guarantees that the flow of liquid metal stops sharply and immediately.

In this regard, if the pressure were to be released after the end of the rotation, metal would continue to flow out of the feeder heads towards the feed circuit. Since it takes a long time for this flow to stop naturally, typically about 10 seconds to several tens of seconds, this would necessarily delay disconnection between the mold and the feed dip tube, or otherwise requires having to fit a liquid-metal container beneath the mold and beneath its path to the next stations.

Incidentally, this metal which runs away would be lost.

In contrast, in the present invention, the closure device allows the metal supplied to remain within the mold, with the result that it contributes almost entirely to the process (an increase in the volume of the feeder heads).

In practice, the closure operation may be carried out by actuating a metal flap placed in the sand mold, as will be described in detail below (a guillotine system), or by any other mechanical solution fulfilling this function.

FIG. 2*c* illustrates the position of the mold 10 after it has been rotated through 180°, the engine block produced being denoted by BM. The arrows F2 indicate the main direction of propagation of the cooling, this cooling taking place essentially via the solid cooler 16 now located in the lower part.

More generally, the process according to the invention advantageously involves one or more coolers that are placed on the opposite side from the feeder head system and are assembled during the series of operations to assemble the main set of chemically bonded sand cores 13.

In the example of the cooler 16 in FIGS. 1 and 2*a* to 2*c*, this makes it possible to accentuate the thermal gradient which drives the solidification towards the feeder heads.

In practice, such coolers preferably consist of blocks of cast iron or of another material having a suitable ability to absorb heat. These blocks may, if required, be shaped, that is to say they may serve, partly, to produce the geometry of the casting.

Preferably, the coolers will be one-piece coolers. They may be placed in the core boxes serving for producing the chemically setting cores and may be inserted into the latter at the time of their production by spraying and curing the resin-coated sand in the core box.

After the casting has solidified in the vertical position, with the cooler at the bottom and the feeder heads at the top (FIG. 2*c*), the two half-frames are laid flat again, in such a way that their parting line is horizontal. They are then carefully separated from each other. The casting is gripped by its cooler(s) and its chemically setting coring system, for example by a robot, and then it undergoes cleaning, for example by brushing, so as to remove as much as possible of the physically setting sand from the casting and from the packet of chemically setting sand.

This separation of the two types of sand allows the sand-recycling costs to be minimized.

Moreover, the cooler or coolers 16, which may be reused, are recovered at this stage.

The casting then undergoes the usual decoring (sand removal), fettling, heat-treatment, machining and inspection cycles.

FIGS. 3*a* to 3*e* diagrammatically illustrate the process of the invention, in which, at the liquid-metal feed runner 22 intended to be connected to the dip tube 20, closure means are provided which are denoted as a whole by the reference 30 and an example of which will be described later.

Figure 3A:
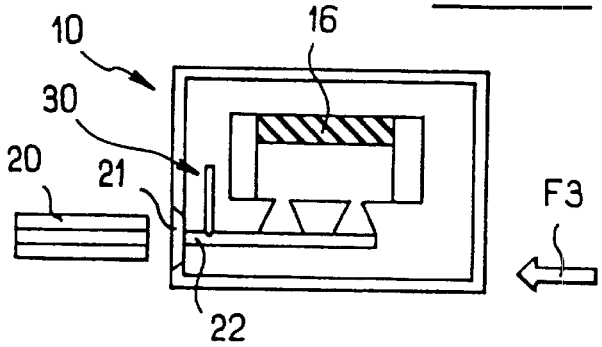
Figure 3B:
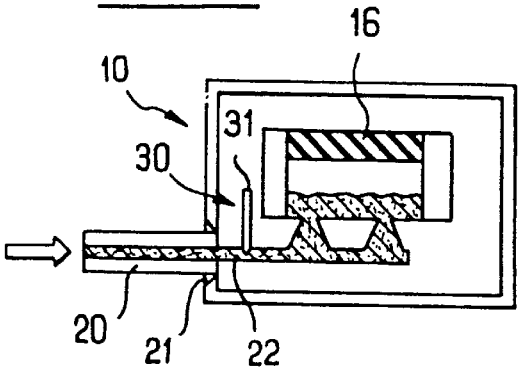
Figure 3C:
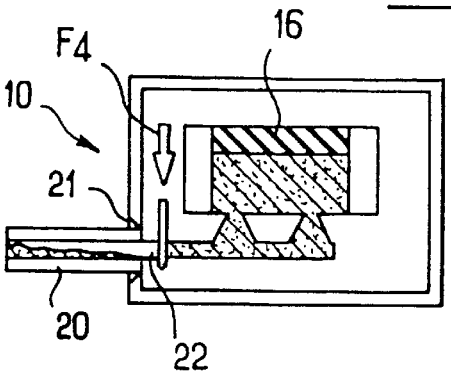
Figure 3D:
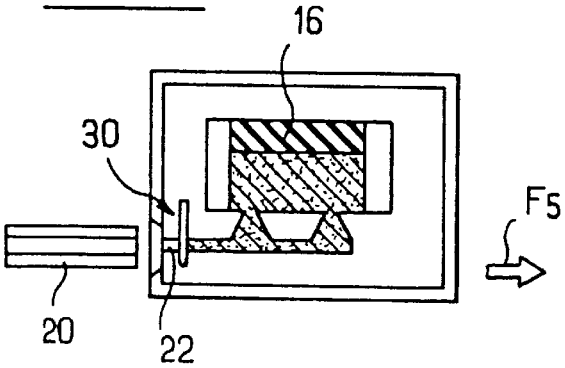
Figure 3E:
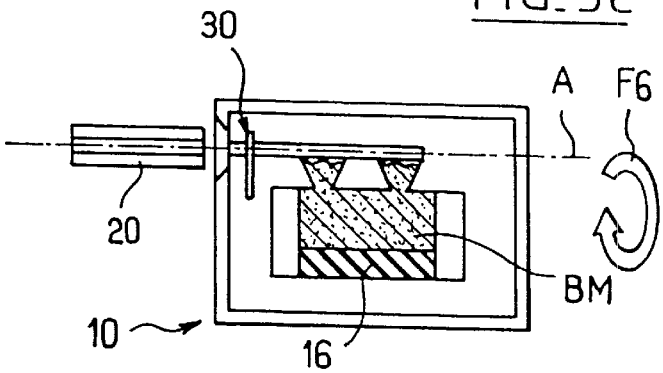

Firstly, the closure means 30 are open and the feed tube 20 is connected to the mold 10*b* by displacing the mold along arrow F3 (FIG. 3*a*). More specifically, by means of an opening 21 made in the mold frame, the feed tube 20 thus comes into contact with the physically setting sand of the mold. The low-pressure filling then takes place (FIG. 3*b*). The closure means are then operated in order to isolate the mold cavity, now filled, from the feed system (arrow F4 in FIG. 3*c*) and then the dip tube 20 is separated from the mold 10 along the direction F5 (FIG. 3*d*). Finally, the mold is turned upside down by rotation about an horizontal axis A (arrow F6 in FIG. 3*e*).

Alternatively, the rotation about the turning axis A may be started as soon as closing off is finished and during depressurization of the furnace. This allows the final drops of the liquid alloy to solidify inside the feed tube 20 during the rotation step, without however such rotation being made under pressure, which is critical with regard to the tightness of the contact surface between the feed tube 20 and the green sand 11*a*, 11*b* of the mold. This also allows a slight increase of production rate of the process.

It will be noted here that disconnecting the feed system from the mold as soon as possible during the process allows the production rates to be increased, it being possible to remove the mold and therefore to connect with the next mold in the production line more speedily.

FIGS. 4*a* to 4*d* and FIG. 5 show a specific illustrative embodiment of the closure means 30. The latter comprise a small metal plate 31, for example made of steel or cast iron, having a thickness of about 2 to 5 mm, inserted into one of the two green sand mold prints (in this case 11*b*) during the production of the latter, so as to be in line with the metal feed runner 22. At its free end facing the runner 22, the plate 31 has two lateral appendages 31*a* intended to allow an easy positioning of the plate 31 while the half-mold 11*b* is build, as well as a better guiding of the plate during its movement into the closure position. For this purpose, the opposite print 11*a* has two approximately complementary cavities 33 into which said appendages may be engaged when assembling the two half-frames.

It will be noted here that the use of green sand for the mold prints allows such a closure device to be produced without any difficulty, the plasticity of the green sand allowing the plate 31 to move, as long as it remains sufficiently thin, without damaging the mold.

Figure 4B:
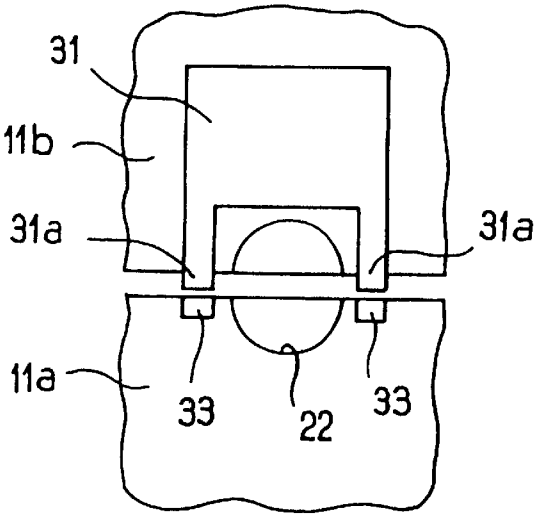
Figure 4D:
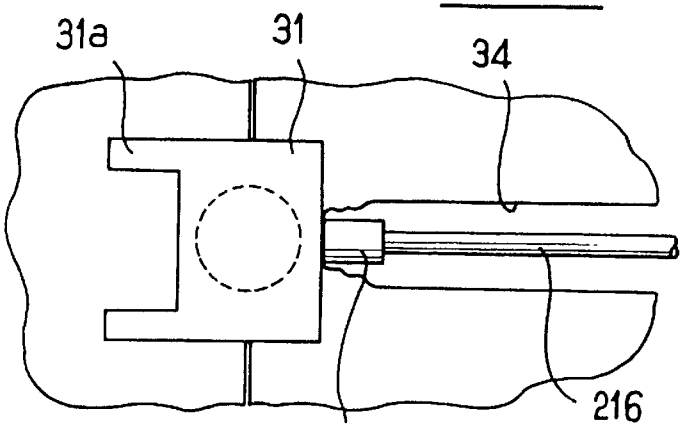
Figure 4A:
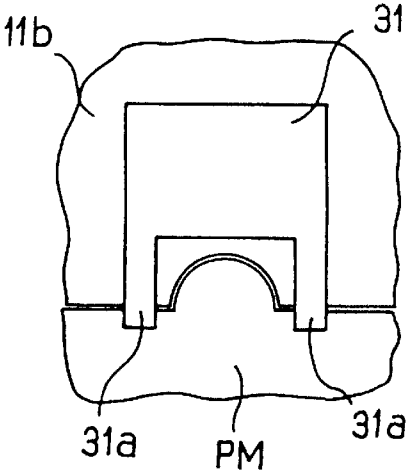

FIG. 4*a* illustrates the construction of the print 11*b* with a pattern plate PM, the print including the closure plate 31 and the two projecting appendages 31*a*.

FIG. 4*b* illustrates how the two half-frames are assembled, the ends of the appendages 31*a*, 31*a* engaging in the cavities 33 in the opposite print.

Figure 4C:
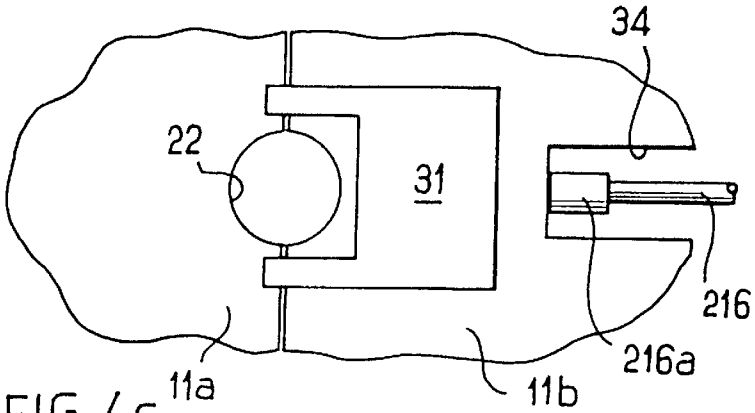
Figure 5:
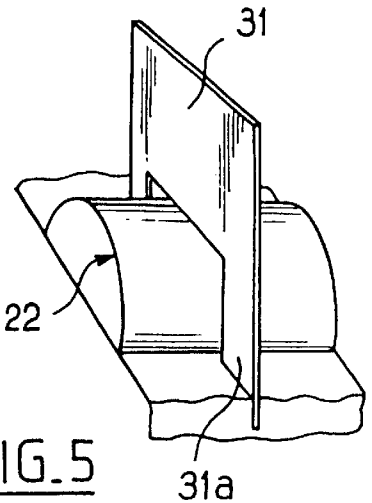

FIG. 4*c* illustrates a cavity 34 formed in the print 11*b* and intended to house the rod 216 and the head 216*a* of a ram intended to act on the plate 31, for closing off the runner 22, before closure. The bottom of this cavity terminates a short distance away from the edge of the plate 31 opposite the runner.

Finally, FIG. 4*d* illustrates the situation after the ram, by means of the rod 216 and of its head 216*a*, has pressed against the plate 31, after locally expelling the green sand, in order to perform closure.

Figure 6A:
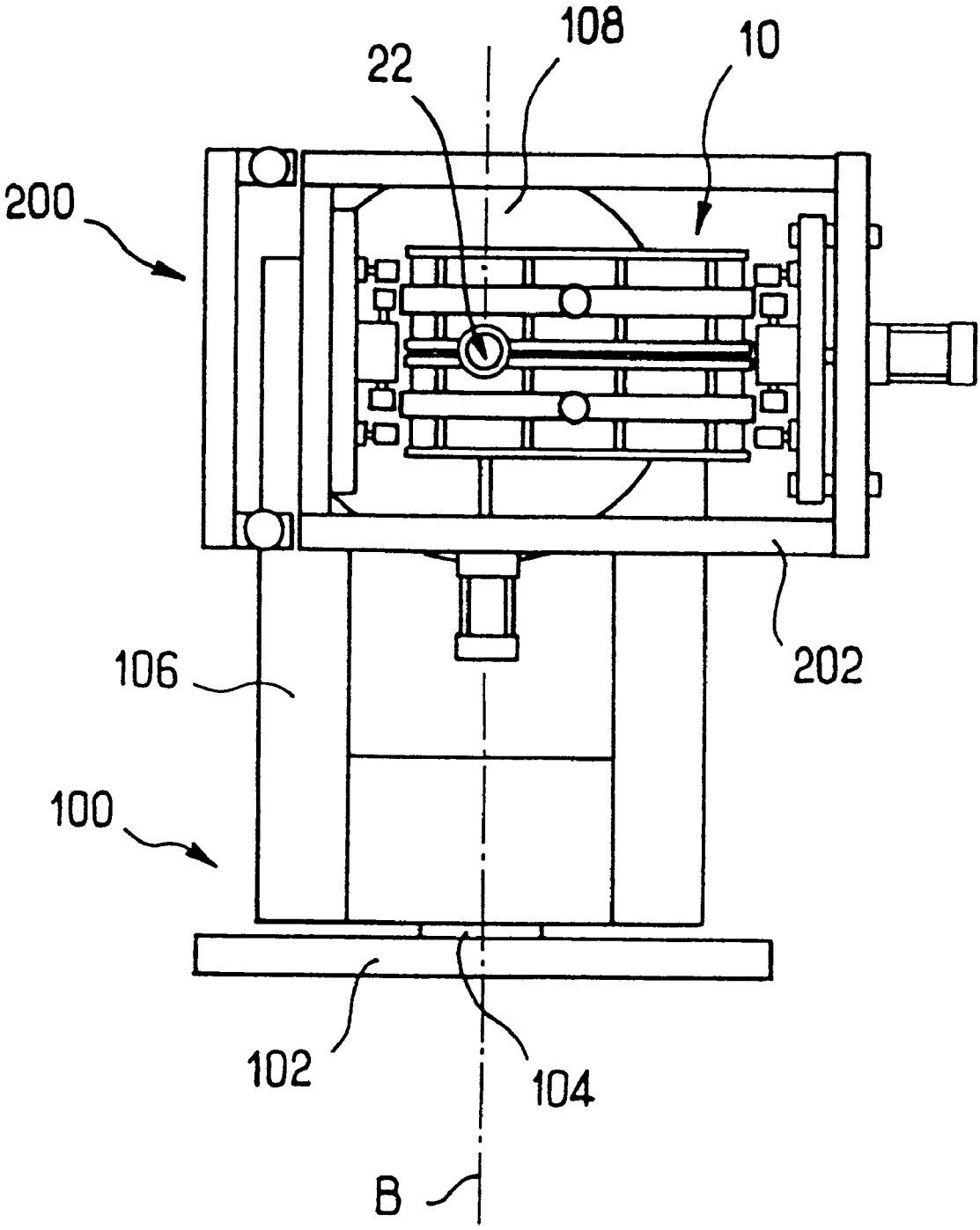
FIGS. 6*a* to 6*c* are diagrammatic front elevations of an item of mold handling equipment which can be used in the process according to the invention, during three successive phases.
Figure 6C:
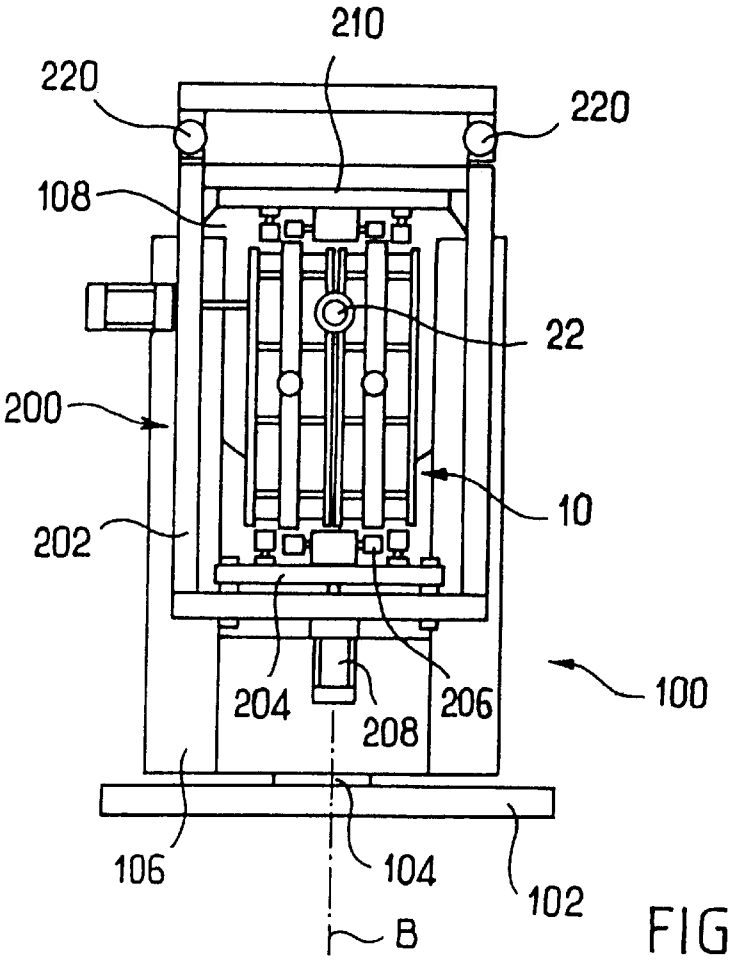
Figure 6B:
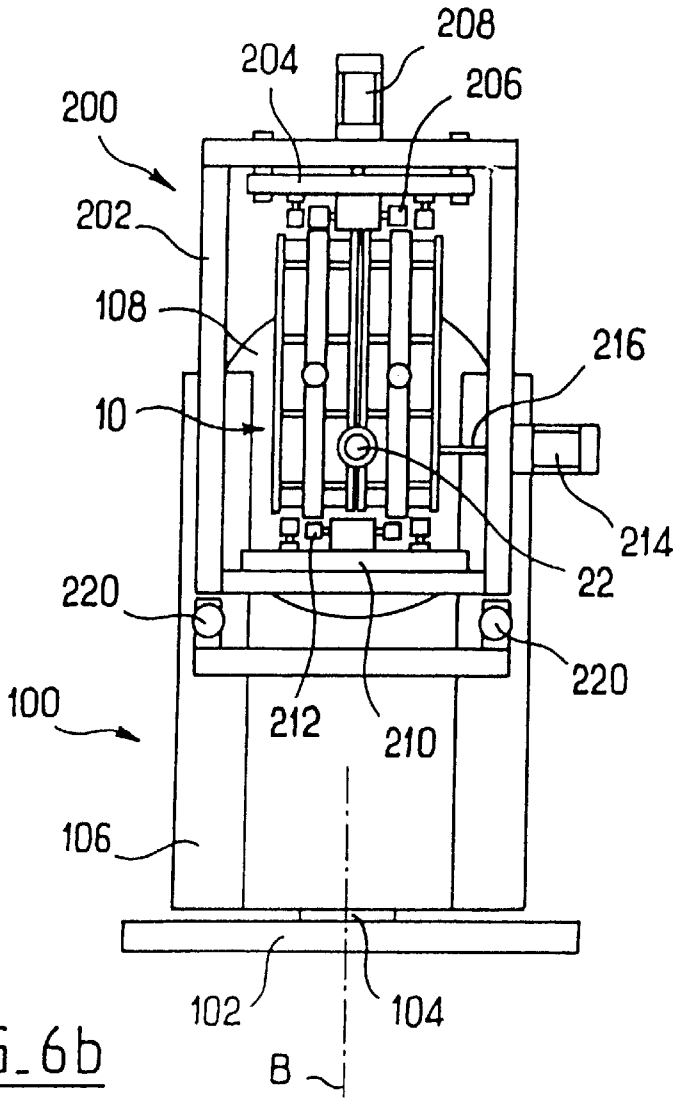

FIGS. 6*a* to 6*c* give an example of an item of equipment EQ for handling the mold, which comprises a main stand 100 comprising a movable framework 106 mounted on a baseplate via a shaft 104 so as to be able to rotate about a vertical axis B, under the action of a motor, in the manner of a carousel.

On the framework 106 is mounted a secondary stand 200 intended to receive a mold 10 and to move it, as will be seen later.

This secondary stand has a frame 202 mounted so as to pivot, for instance on a toothed wheel 108, the rotation of which, about the horizontal axis A, is driven by a suitable motor (not shown).

The mold 10 is mounted in this frame 202 with its feed runner 22 facing the outside, and it is held in place between a press platen 204, which is pressed by a ram 208, and a backing platen 210. Guide rollers 206, 212 defining bearing surfaces in various directions make it possible to guide and hold the mold 10 in position in the equipment.

These figures also show the ram 214 and its output rod 216 allowing the closure plate 31 located in the mold to be operated, as described above.

Figure 7B:
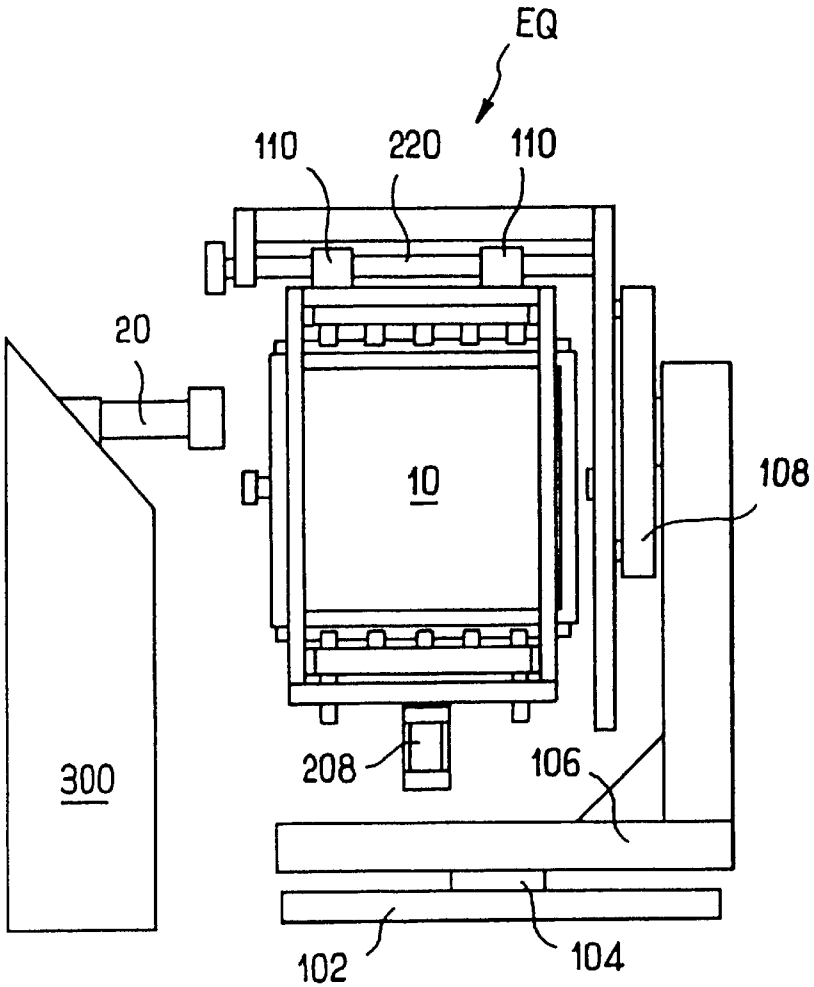
FIGS. 7*a* and 7*b* are diagrammatic side elevations of the equipment in FIGS. 6*a* to 6*c*, during two successive phases.
Figure 7A:
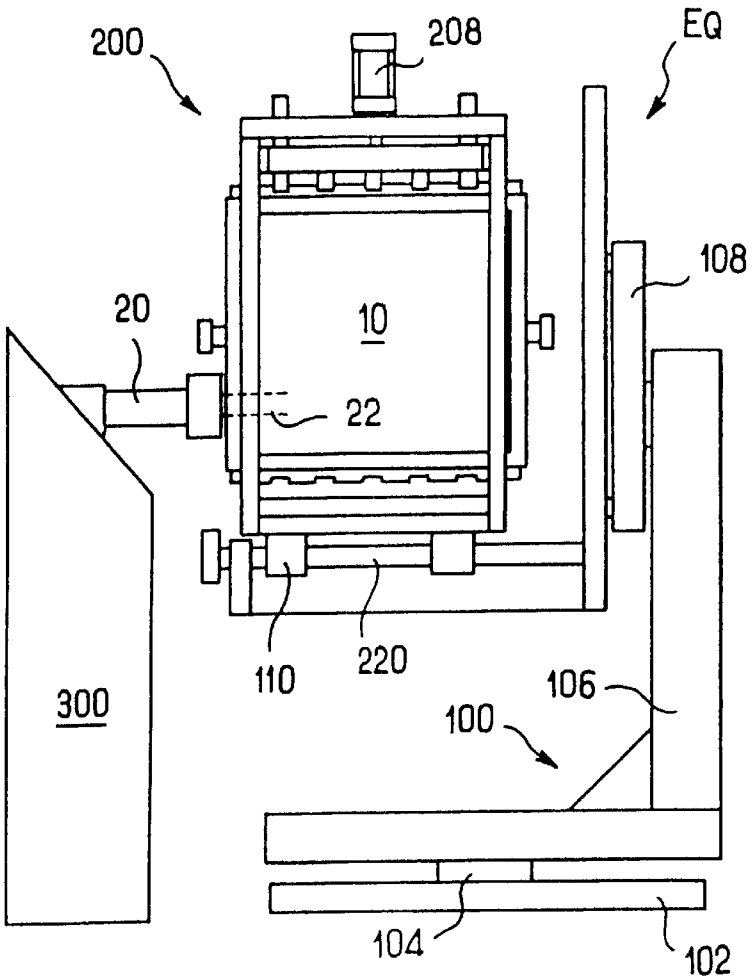

FIGS. 7*a* and 7*b* illustrate the same equipment in side elevation, with the furnace 300 fitted with its feed tube 20. This figure shows that the secondary stand 200 is mounted by means of slides 110 on guide rails 220 fastened to the main stand 106, in order to be able to slide, when the mold 10, together with its feed runner 22, faces the feed tube 20, so that it moves closer to or further away from this tube, under the action of a ram (not shown).

Figure 8A:
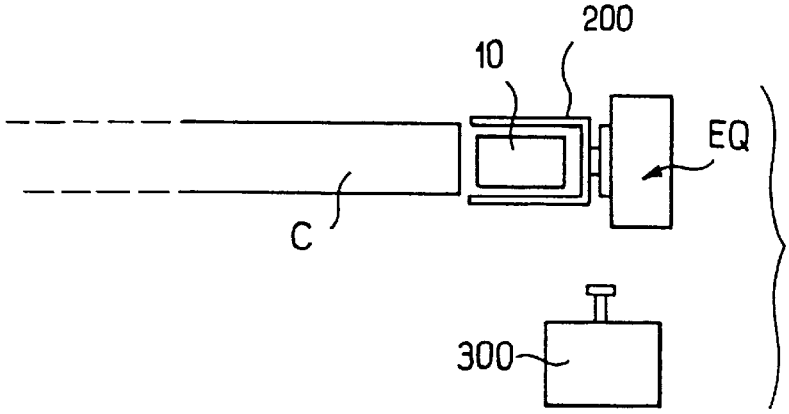
FIGS. 8*a* to 8*c* are diagrammatic top views of the equipment in FIGS. 6*a* to 6*c* and 7*a*, 7*b* and of associated items of equipment, during three successive phases.
Figure 8B:
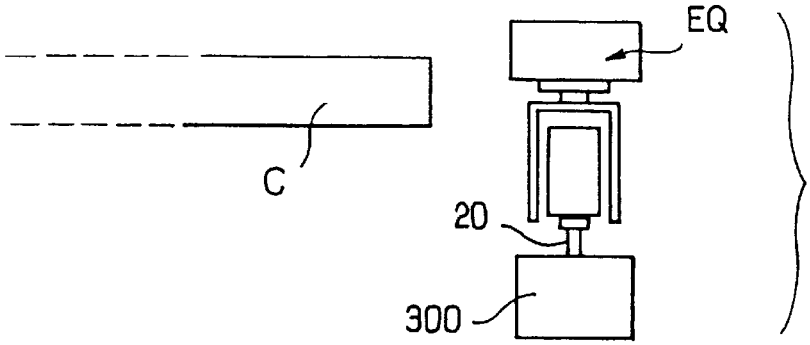
Figure 8C:
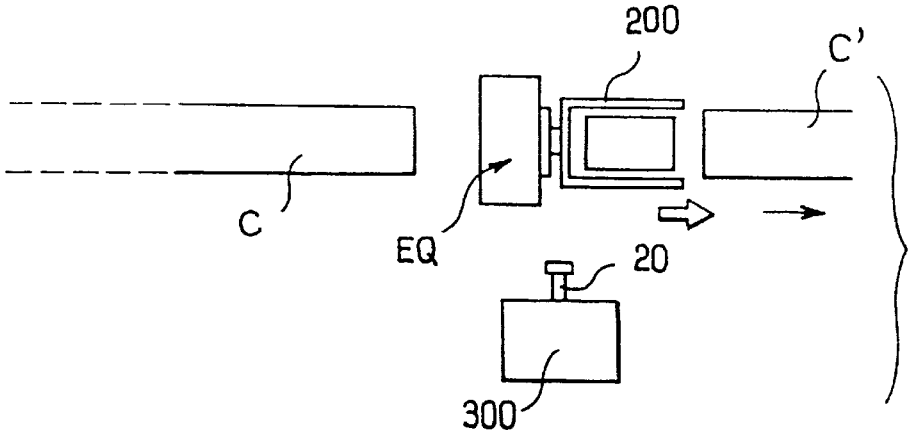

Finally, FIGS. 8*a* to 8*c* illustrate, in top view, the equipment described above, engaged with the conveyor C on which the molds are assembled, the low-pressure furnace 300 and a conveyor C' for taking the products away to the cooling station after casting and rotation.

The various phases of the molding operation will now be described:

in the first place, the mold is assembled on the conveyor C, as described above, and lies in a horizontal position facing the handling equipment EQ into which it has been put, the secondary stand 200 beforehand facing the conveyor with the required orientation (FIGS. 6*a* and 8*a*).

The equipment EQ then rotates through 90° about the vertical axis B, so that the mold 10 is facing the furnace, and, simultaneously or separately, the mold is rotated through 90° so that it adopts its vertical molding position (FIGS. 6*b* and 8*b*).

The mold 10 is then moved translationally towards the furnace 300, in order for the feed tube 20 to be brought into sealed communication with its feed runner 22 (FIG. 7*a*), and the low-pressure casting operation takes place.

After the casting operation, the runner 22 is closed off and the furnace pressure is decreased so as to bring the metal to a level lower than the feed tube 20, and then the mold 10 is separated from the feed tube 20 and rotated through 180° about the horizontal axis, as described above (FIG. 6*c* and 7*b*).

Simultaneously or separately, the stand 200 is rotated through 90° about the vertical axis in order to bring the mold 10 so as to face an output conveyor C' (FIG. 8*c*) which sends the mold to a cooling station.

An example of an engine block produced according to the prior technique (Example 1) and then an example of the same engine block produced using the process according to the invention will now be described in succession.

EXAMPLE 1

A 4-cylinder in-line engine block weighing 18 kg is produced using the low-pressure feed system shown in FIG. 2, but without coolers and with a green sand of the zircon type, having a particle size of 113 AFS and the following composition (in percentages by weight):

bentonite: 1.8%, water: 1.5% the balance being zircon sand.

The corings, for the inside and for the ends (small sides of the block), are made from a chemically setting sand.

The alloy used for the casting has the following composition (in percentages by weight):

Si: 8.6%

Cu: 2.2%

Mg: 0.3%

Fe: 0.4%

Mn: 0.3% the balance being aluminum.

The temperature of the metal during casting is 720° C.

The filling operation is carried out at low pressure and lasts 15 seconds.

Closure of the feed system takes place 2 seconds after the end of filling.

Rotation through 180° takes place 30 seconds after closure.

Examination of the engine block shows a high degree of porosity (from 1.5 to 3%) in the crankshaft bearings and the presence in the casting of bubbles and cavities which may amount to an extension of about one centimeter, something which is completely unacceptable in this type of casting.

EXAMPLE 2

The same engine block is produced using a mold made of silica green sand having a particle size of 55–65 AFS, with the same bentonite and water concentrations as in Example 1. The internal and end corings are made of chemically setting sand, as in Example 1. A cast iron cooler 16 is placed as shown in FIG. 2. The casting and filling conditions are identical to those in Example 1. The closure operation takes place 2 seconds after the end of filling.

Rotation through 180° starts one second after closure and lasts 4 seconds. During this rotation phase, it is advantageous to depressurize the low-pressure furnace used to supply the mold with liquid metal.

Examination of the block shows that there are no defects of the bubble or cavity type and that the structure of the alloy in line with the cooler, in the crankshaft bearings, is sound (less than 0.5% porosity).

Of course, the present invention is in no way limited to the embodiments described and shown, but those skilled in the art will know how to make any variant or modification thereto in accordance with its spirit.

What is claimed is:

1. A process for molding a casting made of light alloy, comprising the following steps:

providing a mold having a metal frame housing a print made of physically setting sand, said frame being defined by a pair of metal half-frames each carrying a half-print, said print having therein a feed runner in communication with a mold cavity and opening to the outside through an opening provided in the frame, for feeding a mold cavity with molten alloy and incorporating a movable closure member for closing off said feed runner, arranging said half-frames with their respective half-prints facing upwardly, wherein cores and inserts can be positioned in said half-prints, assembling said half-frames to each other and bringing the resulting mold in a standing position with said feed runner extending in a substantially horizontal direction, conveying said assembled mold to a mold-holder in a first position, rotating said mold holder around a substantially vertical axis so as to bring said mold holder with said mold in a second position where the feed runner of the mold in said molding stand is located in the lower part of the mold and registers with a feeding tube capable of delivering molten metal alloy, sealingly connecting the feed runner to the feeding tube, applying pressurized metal alloy to the feeding tube so as to fill the mold cavity with said alloy, before solidification of the casting, closing said movable closure member, and then turning the mold-holder with said mold through approximately 180° around a substantially horizontal axis such that incipient solidification in coldest regions of the mold before mold rotation is avoided, rotating said mold holder around said substantially vertical axis so as to bring said mold holder with said mold in a third position where the mold is conveyed from said mold holder to a cooling station, whereby said mold holder becomes available for a further mold.

2. A process according to claim 1, wherein said closing step is carried out in less than approximately ten seconds after the end of the filling step.

3. A process according to claim 1, wherein said turning step is completed at most fifteen seconds, preferably five seconds, after the closing step is completed.

4. A process according to claim 2, wherein said turning step is completed at most fifteen seconds, preferably five seconds, after the closing step is completed.

5. A process according to claim 1, further comprising the further steps of positioning a solid cooler in said mold at a position remote from said feed runner while said half-frames are arranged with their respective half-prints facing upwardly, and recovering said cooler after said alloy has solidified.

6. A process according to claim 1, wherein said connecting step is performed by moving the mold in translation to the feeding tube.

7. A process according to claim 6, wherein the step of moving the mold in translation is performed by sliding the mold relative to the mold holder.

8. A process for molding a casting made of light alloy, comprising the following steps:

providing a mold having a metal frame housing a print made of physically setting sand, said frame being defined by a pair of metal half-frames each carrying a half-print, said print having therein a feed runner in communication with a mold cavity and opening to the outside through an opening provided in the frame, for feeding a mold cavity with molten alloy and incorporating a movable closure member for closing off said feed runner;

placing at least one solid cooler in said mold at a location remote from said feed runner;

assembling said half-frames to each other;

arranging the mold so that the feed runner extends in a lower part of the mold and in a substantially horizontal direction, and the solid cooler is located in an upper part of the mold;

sealingly connecting the feed runner to a feeding tube capable of delivering molten metal alloy;

applying pressurized metal alloy to the feeding tube so as to fill the mold cavity with said alloy; and before solidification of the casting, closing said movable closure member, and then turning the mold-holder with said mold through approximately 180° around a substantially horizontal axis, whereby the feed runner is now located in the upper part of the mold and the solid cooler is located in the lower part of the mold, such that incipient solidification in coldest regions of the mold before mold rotation is avoided and a propagation of the alloy solidification occurs substantially upwardly from said at least one solid cooler.

9. A process according to claim 8, wherein said solid cooler is made of metal.

10. A process according to claim 8, further comprising a step of recovering said at least one solid cooler from the mold after solidification of the casting.

11. A process according to claim 9, further comprising a step of recovering said at least one solid cooler from the mold after solidification of the casting.

12. A process according to claim 8, wherein any cooler included in the mold is disposed away from the feed runner area.

13. A process for molding a casting made of light alloy, comprising the following steps:

providing a mold having a metal frame housing a print made of physically setting sand, said frame being defined by a pair of metal half-frames each carrying a half-print, said print having therein a feed runner in communication with a mold cavity and opening to the outside through an opening provided in the frame, for feeding a mold cavity with molten alloy and incorporating a movable closure member for closing off said feed runner, arranging said half-frames with their respective half-prints facing upwardly, wherein cores and inserts can be positioned in said half-prints, assembling said half-frames to each other and bringing the resulting mold in a standing position with said feed runner extending in a substantially horizontal direction, conveying said assembled mold to a mold-holder in a first position, bringing said mold holder with said mold in a second position where the feed runner of the mold in said molding stand is located in the lower part of the mold and registers with a feeding tube capable of delivering molten metal alloy, sealingly connecting the feed runner to the feeding tube, applying pressurized metal alloy to the feeding tube so as to fill the mold cavity with said alloy, before solidification of the casting, closing said movable closure member, and then turning the mold-holder with said mold through approximately 180° around a substantially horizontal axis such that incipient solidification in coldest regions of the mold before mold rotation is avoided, bringing said mold holder with said mold in a third position where the mold is conveyed from said mold holder to a cooling station, wherein said mold holder becomes available for a further mold.

* * * * *